United States Patent [19]

Stederoth

[11] Patent Number: 5,050,370

[45] Date of Patent: Sep. 24, 1991

[54] DEVICE FOR THE PACKING OF WEIGHED QUANTITIES OF ELONGATED PRODUCTS

[75] Inventor: Wolfgang Stederoth, Friedberg, Fed. Rep. of Germany

[73] Assignee: Spang & Brands Maschinenfabrik GmbH & Co., Friedrichsdorf, Fed. Rep. of Germany

[21] Appl. No.: 526,664

[22] Filed: May 22, 1990

[30] Foreign Application Priority Data

Jan. 20, 1990 [DE] Fed. Rep. of Germany ..... 9000612

[51] Int. Cl.[5] ..... B65B 39/00; B65B 35/24; B65G 47/18

[52] U.S. Cl. ..... 53/502; 53/142; 53/255

[58] Field of Search ..... 53/502, 167, 143, 142, 53/249, 250, 251, 255

[56] References Cited

U.S. PATENT DOCUMENTS

| | | | |
|---|---|---|---|
| 1,142,136 | 6/1915 | Bates | 53/142 X |
| 2,846,830 | 8/1958 | Bossi | 53/143 X |
| 3,008,281 | 11/1961 | Wayne et al. | 53/393 |
| 3,468,098 | 9/1968 | Eisenberg | 53/142 X |
| 3,807,124 | 4/1974 | Kihnke . | |
| 3,988,874 | 11/1986 | Altenpohl et al. | 53/142 X |
| 4,607,478 | 8/1986 | Maglecic | 53/502 |
| 4,821,493 | 4/1989 | Pintsov | 53/502 |

FOREIGN PATENT DOCUMENTS

| | | |
|---|---|---|
| 0056946 | 8/1982 | European Pat. Off. . |
| 0121961 | 6/1987 | European Pat. Off. . |
| 1070988 | 4/1962 | Fed. Rep. of Germany . |
| 1271020 | 6/1968 | Fed. Rep. of Germany . |
| 3533201 | 3/1987 | Fed. Rep. of Germany . |
| 1193852 | 6/1970 | United Kingdom . |

*Primary Examiner*—James F. Coan
*Attorney, Agent, or Firm*—Larson & Taylor

[57] ABSTRACT

A device is provided for packing elongated products, e.g. carrots, in weighed quantities which comprises a weighing station (10) with a plurality of scales (12) arranged parallel to one another and including weighed-products containers (14). The weighed products drop through a series of swiveling feed hoppers (16) and selectively through one or the other of two separate series of guiding chutes (18, 20) onto one of two conveyor belts (22, 24) each associated with a respective one of the series of chutes. In order to avoid damage to the products and to accelerate the discharge thereof onto the conveyor belts (22, 24) in the direction of movement of the conveyor belts, intermediate baffles of each series of guiding chutes are curved or bent in such a manner that the elongated products are deflected while maintaining an essentially parallel alignment in the direction of movement of the relevant conveyor belt (22, 24).

4 Claims, 2 Drawing Sheets

DEVICE FOR THE PACKING OF WEIGHED QUANTITIES OF ELONGATED PRODUCTS

The invention relates to a device for packing elongated products, for instance carrots, in weighed quantities, the device comprising a weighing station with a plurality of scales and at least one packing machine connected thereto by means of guiding chutes and a conveyor belt.

In a known device of this type various separate partial quantities drop onto the individual scales randomly. A control device compares the weights of the partial quantities of all of the scales and selects those scales for which the partial quantities come closest to the total sum of the theoretical weight of a package which is to be produced. The bottom walls or floors of the scales which have been selected are then opened, and the contents drop in turn through a guiding chute onto a conveyor belt, which feeds the package quantities received together thereon to the packing machine.

In order to provide proper operation of the device without breakdown and in consideration of the appearance of the filled packages, the elongated products are to be aligned as uniformly parallel as possible during their transport on the conveyor path from the weighing station to the packing machine. Further, despite the required mechanical action of dropping of the product, the products are not to be damaged. Until this time, however, these objects were not adequately attainable because of the extensive time cycle frequency inherent in the mechanism and the correspondingly high velocity of the conveyor belt.

The object of the invention is to provide a device of the above type which allows for high cycle frequency while also protecting and preserving the products during the transport of the products from the weighing station to the packing machine.

The aforementioned object is attained according to the invention by providing that each of the guiding chutes is, from the top thereof, bent or curved so that a component of velocity in the direction of movement of the conveyor is imparted to the products during the travel thereof downwardly through the chute and so as to prevent free fall of a product downwardly through the chute.

The invention first offers the advantage that the products do not drop vertically, in free fall, through the guiding chute onto the conveyor belt, in a condition wherein the points of carrots could be broken, but rather the products slide along on the baffles of the guiding chute and thus during their passage are already being guided or steered in the direction of conveyance. The lower relative velocity shortens the phase in which the products are being thrust along following their first impingement on, i.e., contact with, the conveyor belt, so as to be bouncing or spinning along the conveyor belt in a random pattern because of the belt velocity. Further, the lower relative velocity thus shortens the transport time, upon which depends the cycle frequency. If desired, the process can also be carried out at a higher belt velocity. Finally, one further advantage of the invention resides in the fact that with identical cross sections of the guiding chutes, the length of the fall can optionally be shortened, because products of certain lengths and certain diameters cannot be so easily jammed or wedged between obliquely opening guide passages and the conveyor as would be the case with vertical guiding chutes and the conveyor.

It is especially important that the invention is provided for devices with two (or optionally even more) conveyor belts. To explain, in such devices another baffle must then be inserted between the scales and the guiding chutes, for instance in the form of a swiveling chute part, so that the length of the drop between scales and the conveyor belt is even further increased. In this situation, in accordance with the device of the invention, a higher velocity can be obtained in the direction of conveyance as a result of the greater height of the drop (which otherwise would be only disadvantageous) prior to delivery of the products onto the conveyor belt.

An exemplary embodiment of the invention is explained in greater detail hereinafter relative to the drawings. In the drawings.

Figure 1:
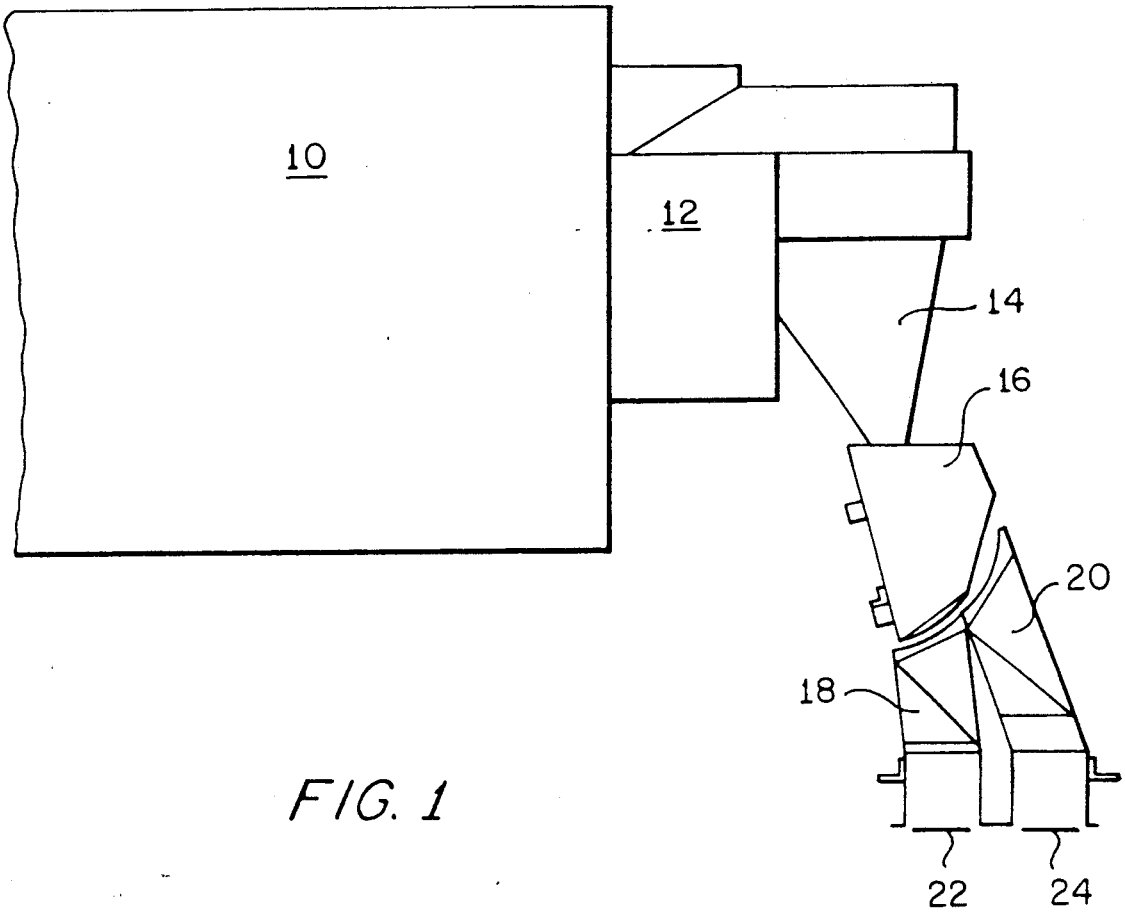
FIG. 1 is a simplified side view of a weighing station with guide chutes attached thereto for the delivery of weighed products alternatively onto one of two conveyor belts.
Figure 2:
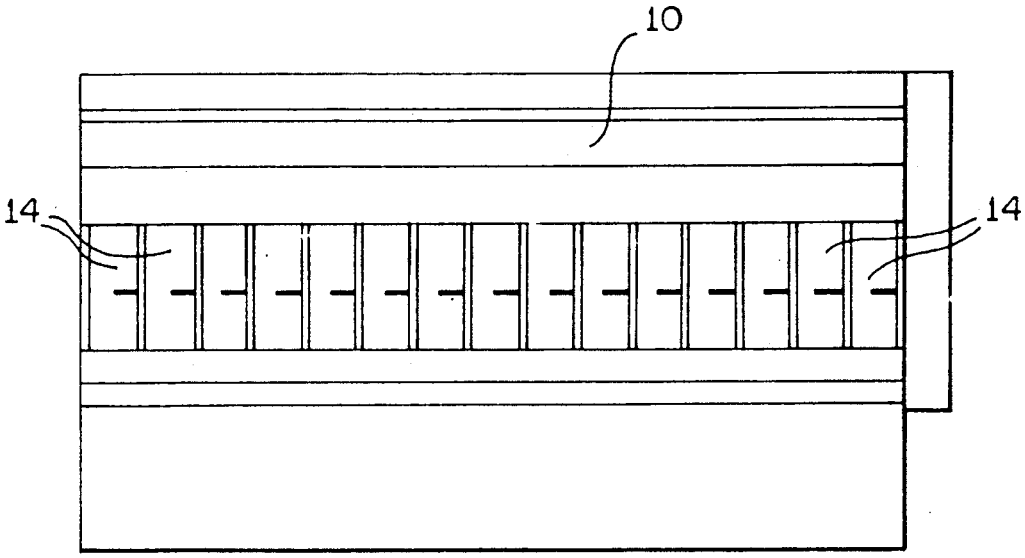
FIG. 2 is a partial plan view of the device of FIG. 1.

A weighing station is shown in FIGS. 1 and 2, which is generally indicated at 10 and includes, in the example illustrated, fifteen scales, denoted 12, each, in turn, having an associated container 14 for the weighed products. The products, e.g., carrots to be weighed and packed, are fed into the entire series of fifteen weighed-products containers 14 in a line from one end to the other. The scales 12 can, for instance, be set so that an obstructing closure is permitted to open at the inlet opening of the relevant weighed-products container 14 for a certain length of time, until the weight of the carrots dropping into the weighed-products container reaches approximately ¼ the weight of the package to be produced. Thereafter, the inlet into weighed-products container 14 is again closed.

Because there are many different sizes of carrots, the fifteen scales 1 generally establish different weights in terms of partial quantity weights contained in the weighed-products containers 14. A control device (not shown) is used to compare the weights and to then select from the fifteen scales those four scales the contents of which, added together, come closest to the desired theoretical weight of the packages to be produced. The control device then releases the opening mechanisms of the bottoms of the selected four weighed-products containers 14. The contents of these four containers drop down into and through swiveling feed hoppers 16 which are arranged parallel to one another in side-by-side relation in the same manner as the weighed-products containers 14, or through some other suitable intermediate chutes. Each batch of contents is fed according to the setting of the corresponding swiveling hopper 16 through guiding chutes 18 of a first series of guiding chutes (which are likewise arranged in parallel one adjacent to the other), or else through guiding chutes 20 of a second series of guiding chutes (which are similarly arranged). The contents of chutes 18 empty onto a conveyor belt 22 located under chutes 18 and the contents of chutes 20 empty onto a conveyor belt 24 located under chutes 20. The two conveyor belts 22 and 24 carry their loads in opposite directions each to a conventional packing machine (not shown). Since the cycle time of the weighing station is only approximately half the cycle time of a packing machine, one weighing station can work together with two packing machines. Thus, using the disclosed arrangement, swiveling feed hopper 16 is directed alternately over the series or assembly of guiding chutes 18 onto conveyor belt 22 and then over the series or assembly of guiding chutes 20 onto conveyor belt 24.

The weighed-products containers 14 are configured as funnels so that the elongated products occupy an essentially vertical position in them. To ensure that the products do not somersault or turn over or turn end over end while dropping out of the weighed-products container 14 through swiveling feed hoppers 16 and guiding chutes 18 or 20, the swiveling feed hoppers and guiding chutes have horizontal cross sectional profiles of which the larger cross sectional dimension is smaller than the normal length of the product.

If in addition to the swiveling feed hoppers 16, the guiding chutes 18 and 20 are aligned vertically, the products i.e., carrots, would then fall out of weighed-products containers 14, would fall over a considerable travel distance essentially vertically downward onto one of the conveyor belts 22 or 24 and would there bounce and tumble with great weight and force on their pointed ends. A transverse shearing force is added to the impact caused by the considerable height through which the carrots fall, caused by the transverse force which is exerted on the carrots by the moving conveyor belt, and with the speed of the belt, the relative horizontal velocity has a maximum value. These strains and loads would thus result in a situation in which many carrots (or other elongated products) would be destroyed during impact with the conveyor belts.

Figure 4B:
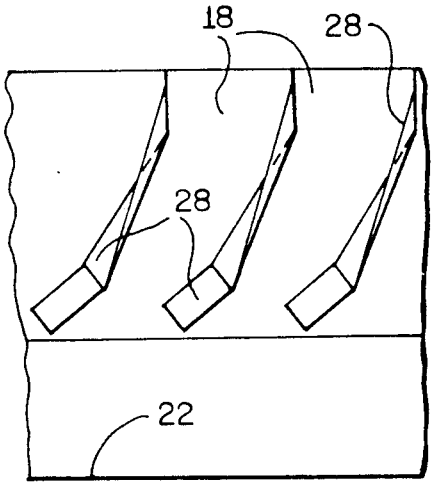
FIGS. 4A and 4B are cross sections taken along lines A—A and B—B of FIG. 3.
Figure 4A:
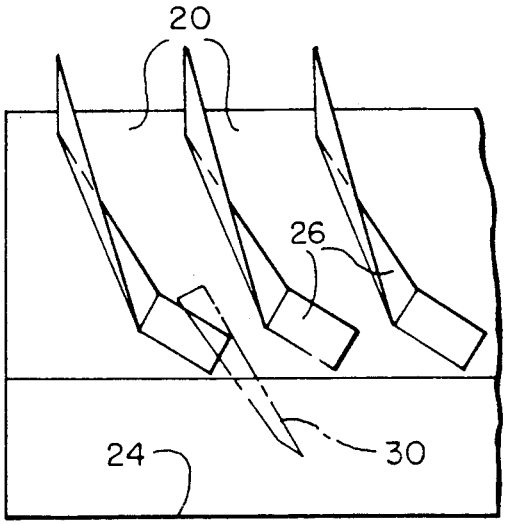

In order to avoid these problems, intermediate baffles 26 shown in FIG. 4A are provided between the guiding chutes 20 and are bent or curved with a multiplicity of bends in the direction of movement of conveyor belt 24, i.e., as viewed beginning from the bottom of FIG. 4A, are bent to the left. Further, as illustrated, starting from vertical alignment of the intermediate baffles 26 in the top area, with each bend the deviation from the vertical increases progressively from the top to the bottom. The same is true for the intermediate baffles 28 shown in FIG. 4B between the guiding chutes 18 over conveyor belt 22, except that in this case, because of the opposite direction of movement of conveyor belts 22 and 24, the direction of the bend or curve in intermediate baffle 28 is also opposite that of intermediate baffles 26.

Figure 3:
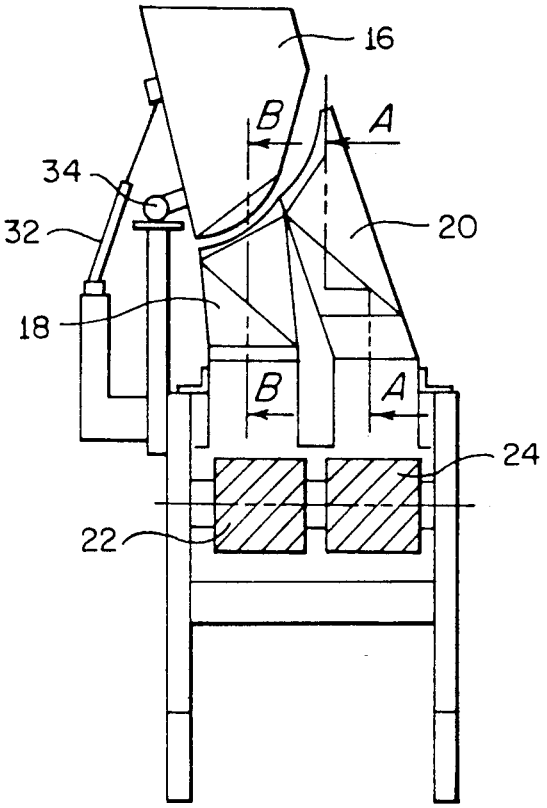
FIG. 3 is a cross section through the guiding chute of the device of FIG. 1 with the conveyor belts arranged thereunder.

The number and positions of the bent edges, or alternatively the curves, for instance, of baffles 26, 28 as produced by a deep drawing process, preferably using sheet metal, depends on the length and diameter of the products (indicated at 30 in FIG. 4A), on the distance of drop, the speed of the associated belt and the positions of conveyor belts 22 and 24 with regard to the discharge openings of weighed-products containers 14. When, as in the cross section of FIG. 3, guiding chutes 18 and 20 do not extend perfectly vertically, but rather have some inclination, there should preferably be provided not only bent edges which lie parallel to the surfaces of the conveyor belts, but also bent edges arranged oblique to the horizontal, as is the case shown in the illustrative example. Similarly, as in the case of a super-elevated curve provided in highway construction, the bent edges running oblique to the horizontal are to be laid out so that the products sliding out of swiveling feed hoppers 16 to the right in FIG. 3 are deflected generally downwardly in the outside guiding chutes 20, and thus are guided or steered in the direction of movement of the conveyor belt.

The bottom bend of each of intermediate baffles 26 and 28 also has the further purpose of precluding any clamping and jamming of the products between the conveyor belt, the bottom edge of a baffle 26 or 28 and the next intermediate baffle lying in the direction of conveyance (the direction of movement of the associated conveyor) for the purpose of promoting the conveyance operation, when the bottom edges of baffles 26, 28 are positioned as near as possible to conveyor belts 22, 24. For the same reasons, the horizontal distance between the individual baffles 26 or 28 be preferably to be greater than three times the diameter of products 30. As shown in FIG. 3, the top edges of intermediate baffles 26 and 28 have the shape of an arc of a circle, and the discharge from swiveling feed hopper 16 is also in this configuration, to adapt to the shape of the arc. The radius of the circular arc depends on the swivel radius of the discharge opening of swiveling feed hopper 16 so that as narrow as possible a transition gap is present between swiveling feed hopper and guiding chute 18 or 20 when swiveling feed hopper 16 is swiveled by means of a power cylinder 32 around an axis 34 between its two end positions in which the feed hopper 16 cooperates with either guiding chute 18 or guiding chute 20.

It is to be understood that the scope of the invention is independent of the construction of the weighing station and the configuration of the alternating feed chute, which is described herein in the form of a swiveling feed hopper 16 solely as an example. The concept according to the invention then can be used advantageously even from the moment when the weighed product drops out of weighed-products container 14 directly through one single guide chute onto one single conveyor belt and thus can be deflected from the drop line in the direction of movement of the conveyor belt within the guiding chute while maintaining its alignment, in other words with one end forward. One further possible application resides in the incorporation of guiding chutes over two or more conveyor belts moving in the same direction, so that in this case the intermediate baffles 26, 28 would be curved or bent in the same direction.

I claim:

1. In an apparatus for packing elongated products in weighed quantities, said devices comprising a weighing station with a plurality of scales, at least one packing machine, and means, including a plurality of guiding chutes for keeping the products received thereby aligned during the travel thereof downwardly through the chutes and at least one associated conveyor belt for receiving products discharged from the guiding chutes, for interconnecting the scales and the packing machines, the improvement wherein the guiding chutes are each, from the top thereof downwardly, bent or curved at least in the discharge area thereof so that a component of velocity in the direction of movement of the conveyor belt is imparted to the products during the travel thereof downwardly through the chute, and so as to prevent free fall of a product downwardly through the chute, the vertical distance between the bottom edge of the baffles defining the guiding chutes and the conveyor belt being smaller than the greatest length of a product but being sufficiently great to preclude a product from simultaneously contacting two baffles and the conveyor belt, the guiding chutes being disposed directly adjacent to each other in the direction of movement of the conveyor belt so that the rear baffle of one chute is the front baffle of the adjacent chute, the greatest width of the cross section of the chute being smaller than the length of the elongate products so that the products cannot turn when falling through the chute and so that the products thus fall onto, and lie upon, the conveyor belt lengthwise of the belt, and said apparatus providing a continuously, unobstructed opening at the lower ends of said chutes.

2. A device as claimed in claim 1, wherein baffles defining the guiding chutes deviate from the vertical in the direction of conveyance as a result of a plurality of vertically arranged bends one below the other from the top downward, the amount of the bending or curvature increasing progressively away from the vertical.

3. A device as claimed in claim 2, wherein at least one edge formed by a bend extends obliquely to the horizontal over the width of one baffle.

4. A device as claimed in claim 1 comprising two conveyor belts having opposite directions of movement, arranged adjacent each other, two sets of guiding chutes with opposite inclinations, arranged adjacent to one another above respective ones of said conveyors; and, disposed between the scales and the sets of guiding chutes, a plurality of pivotable hoppers for selectively and alternately guiding products released from the scales into one or the other of the sets of guiding chutes and thus onto the respective conveyor belt of said two conveyor belts.

* * * * *